US006431397B1

(12) United States Patent
Fishman

(10) Patent No.: US 6,431,397 B1
(45) Date of Patent: Aug. 13, 2002

(54) METHOD AND MEANS FOR DISPENSING RELEASABLE LABELS FROM ROLL-STOCK SUBSTRATE

(76) Inventor: Sherman S. Fishman, 295 Stevenson Dr., Pleasant Hill, CA (US) 94523-4149

( * ) Notice: Subject to any disclaimer, the term of this patent is extended or adjusted under 35 U.S.C. 154(b) by 0 days.

(21) Appl. No.: 09/592,453

(22) Filed: Jun. 9, 2000

(51) Int. Cl.[7] ..... B65H 5/28
(52) U.S. Cl. ..... 221/73; 221/70; 156/584
(58) Field of Search ..... 221/73, 70; 156/584

(56) References Cited

U.S. PATENT DOCUMENTS 2,754,994 A * 7/1956 Cole
2,912,140 A * 11/1959 Cole
4,818,850 A * 4/1989 Gombrich et al. ..... 235/494
5,071,030 A * 12/1991 Marcusen ..... 221/2
5,570,809 A * 11/1996 Martin ..... 221/73
5,806,714 A * 9/1998 Geiger ..... 221/73
5,863,384 A * 1/1999 Reddy ..... 156/576
5,941,413 A * 8/1999 Roman ..... 221/73
6,171,439 B1 * 1/2001 Groeneweg ..... 156/584
6,227,406 B1 * 5/2001 Herlacher ..... 221/185

* cited by examiner

*Primary Examiner*—Robert P. Olszewski
*Assistant Examiner*—Steven B. McAllister

(57) ABSTRACT

The subject of this invention is a container with new releasing mechanism for any material such as self-adhesive blank stock, printed labels, and the like. The material to be dispensed must be on a releasable substrate such as polyethylene coated base paper or wax paper and the like. These materials come in rolls which are stored inside the container and the dispensing end of the roll-stock feeds out through an exit slit onto the releasing mechanism which separates the label from the substrate base paper. The releasing mechanism is adaptable to more than one type of container. The releasing mechanism will separate the label from the substrate support.

6 Claims, 10 Drawing Sheets

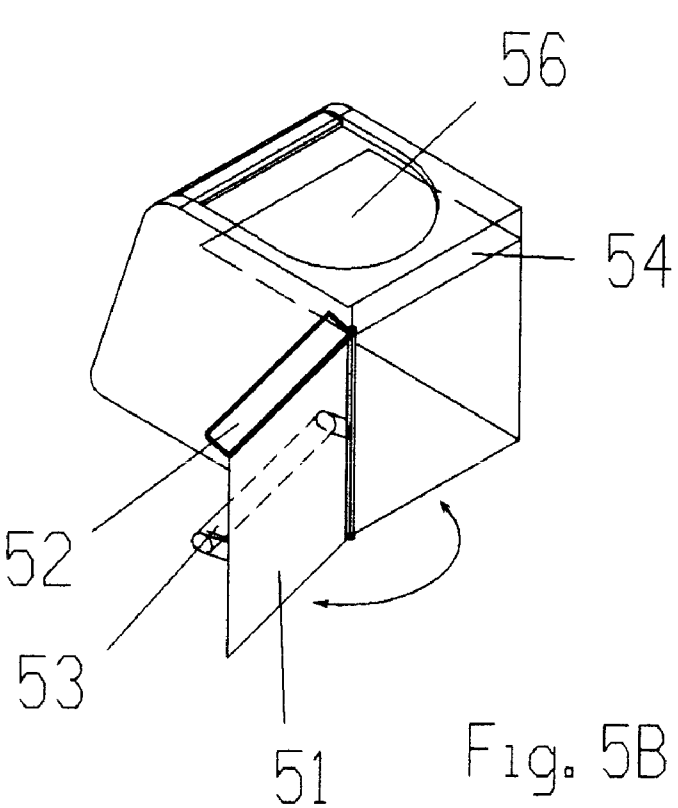
Fig. 5B
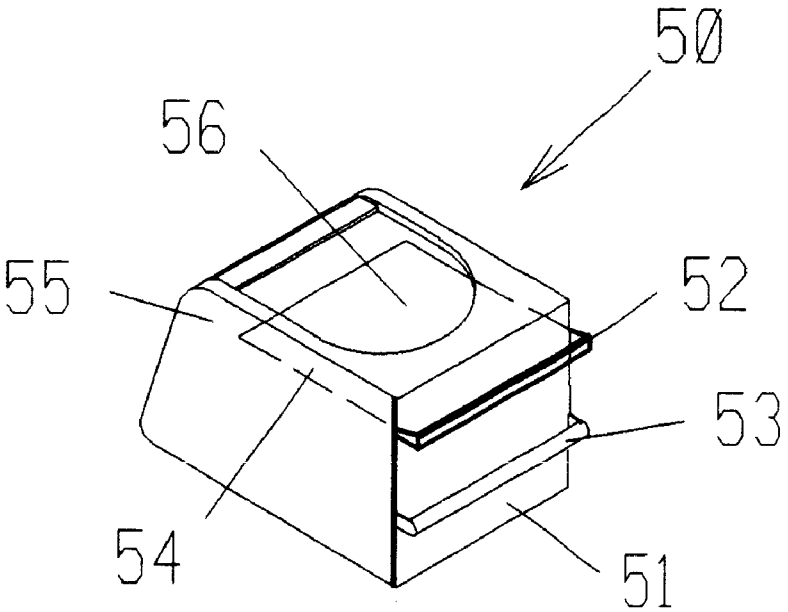
Fig. 5A
Fig. 5

METHOD AND MEANS FOR DISPENSING RELEASABLE LABELS FROM ROLL-STOCK SUBSTRATE

RELATED APPLICATIONS

This is a substitute application to Ser. No. 08/839,628 filed Apr. 15, 1997, now abandoned. During pendency of the now abandoned application there was no public use or announcement. Such models that were made as samples were given to interested parties who signed a confidential non-disclosure form.

BACKGROUND OF THE INVENTION

This invention is in the area of dispensing self-adhesive labels which are on a substrate support paper which is coated with wax or polyethylene and the labels can be peeled off. The material to be dispensed is on a roll or coil stored inside a container. By means of a releasing mechanism, labels and the like on the roll can be removed from the substrate base support and dispensed one unit at a time. This invention relates to preprinted labels, which have a self-adhesive backing on one surface and are mounted on a paper substrate base support with a wax or polyethylene coating from which the labels and the like can be removed.

DESCRIPTION OF PRIOR ART

A search of the following patents does not appear to show that they have anticipated the invention disclosed herein:

U.S. Pat. No. 4,191,306; 4,706,843; 4,568,211; 3,930,697; D369385; D368115; D365852; D363742; D362684; D361785; D361037; D359511; D310102; D293338; D264520; D256330; D252756.

SUMMARY OF THE INVENTION

This invention is a container with new releasing mechanism. It provides a means for storing and dispensing roll-stock of pre-printed self-adhesive releasable labels, and the like. It operates by feeding the roll-stock dispensing end through an exit slit on one side of the container, exiting the container and following a pathway which passes the roll-stock onto a releasing mechanism. The releasing mechanism consists of a turning member on the outer surface of the exit slit and one or more guide bar or rod members under which the substrate paper is passed. The turning member will elevate the roll stock. The turning member surface is angled in the range of 80 to 135 degrees from the exit direction. The substrate paper passes under a second member, a guide bar, which is adjacent to but separated from the turning member. The pathway for the roll stock is: exit the container through an exit slit, pass over the turning member, at which point the label separates from the substrate base paper. The substrate paper turns downward and passes under the guide bar or rod and is discarded. This pathway is the same in containers in a variety of sizes and shapes.

BRIEF DESCRIPTION OF THE DRAWINGS

FIG. 5. A top angled view of a one part container having a shortened inside shelf, a hinged door closure closed in FIG. 5A and open in FIG. 5B with releasing mechanism attached.

TABLE OF LEGEND NUMBERS & DEFINITIONS

Figure 1:
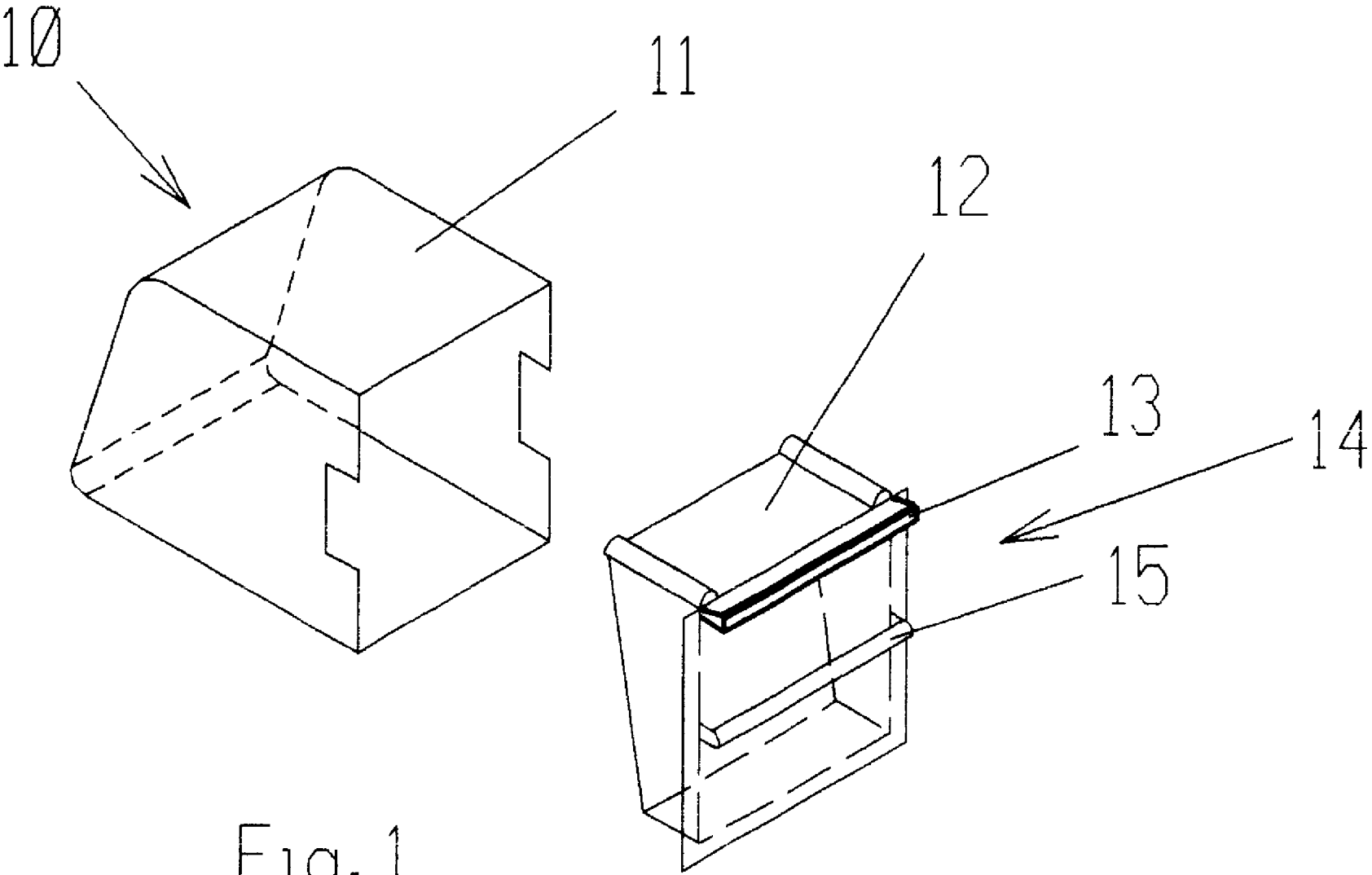
FIG. 1. An exploded view of a two part container having one side open on the outer shell and a closure insert with a releasing mechanism attached.

FIG. 1. 10 two part container assembly

11 outer shell

12 insert closure means

13 turning member

14 releasing mechanism assembly adjacent to exit slit

15 guide bar

Figure 2:
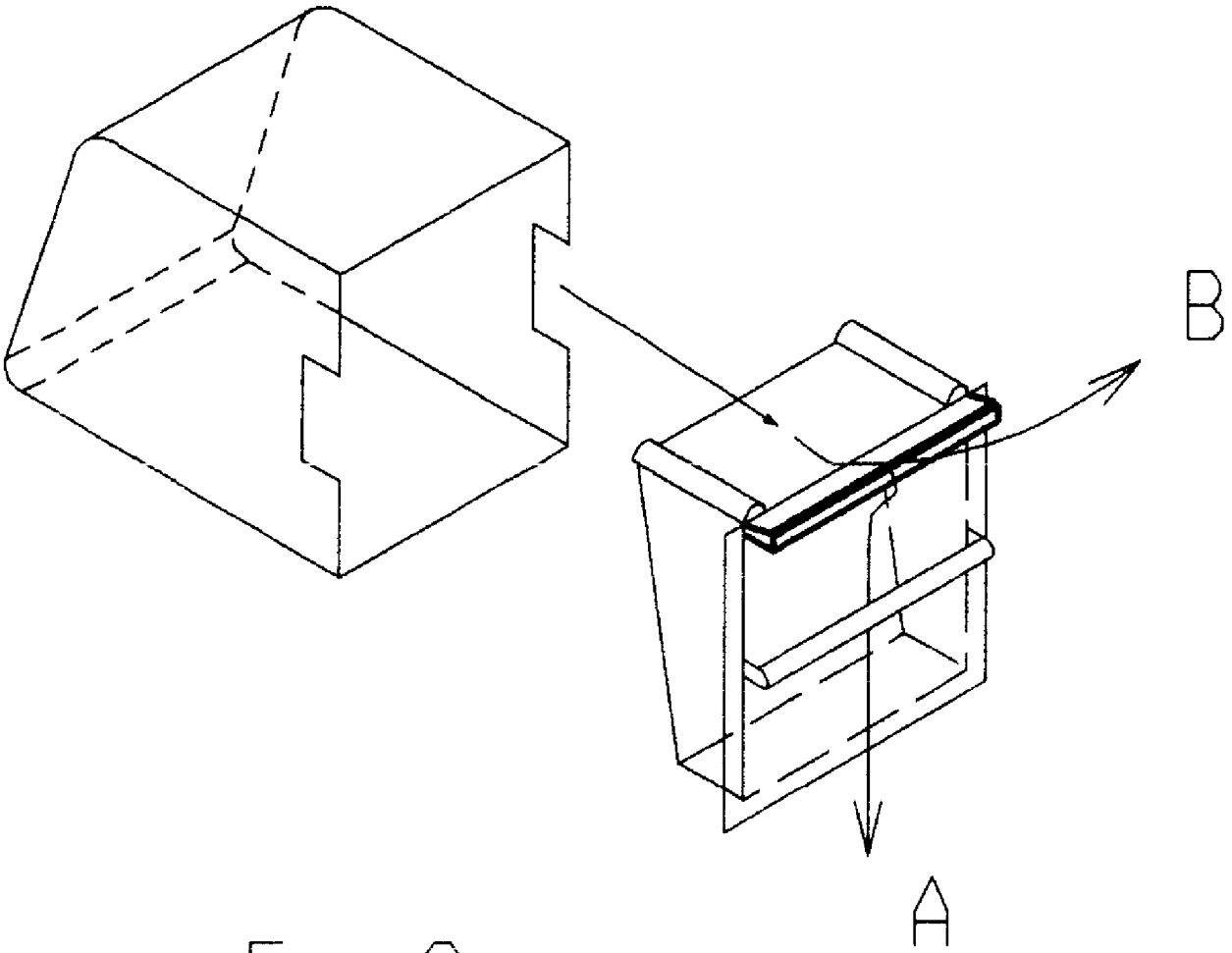
FIG. 2. The container of FIG. 1 showing the pathway for dispensing self-adhesive labels.

FIG. 2. A pathway for substrate base paper

B pathway for dispensed label

Figure 3:
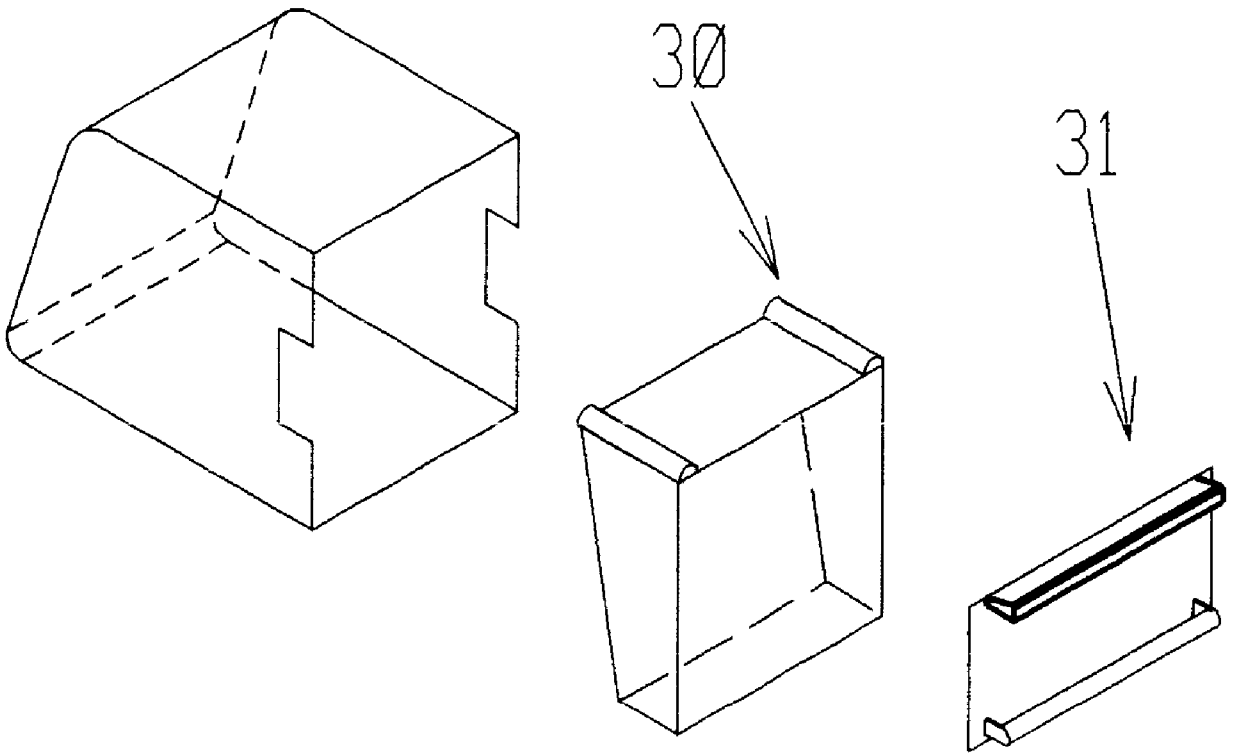
FIG. 3. An exploded view of the outer shell and insert having releasing mechanism detached.

FIG. 3. 30 assembly showing insert closure with releasing mechanism detached.

31 releasing mechanism assembly detached from insert closure means.

Figure 4:
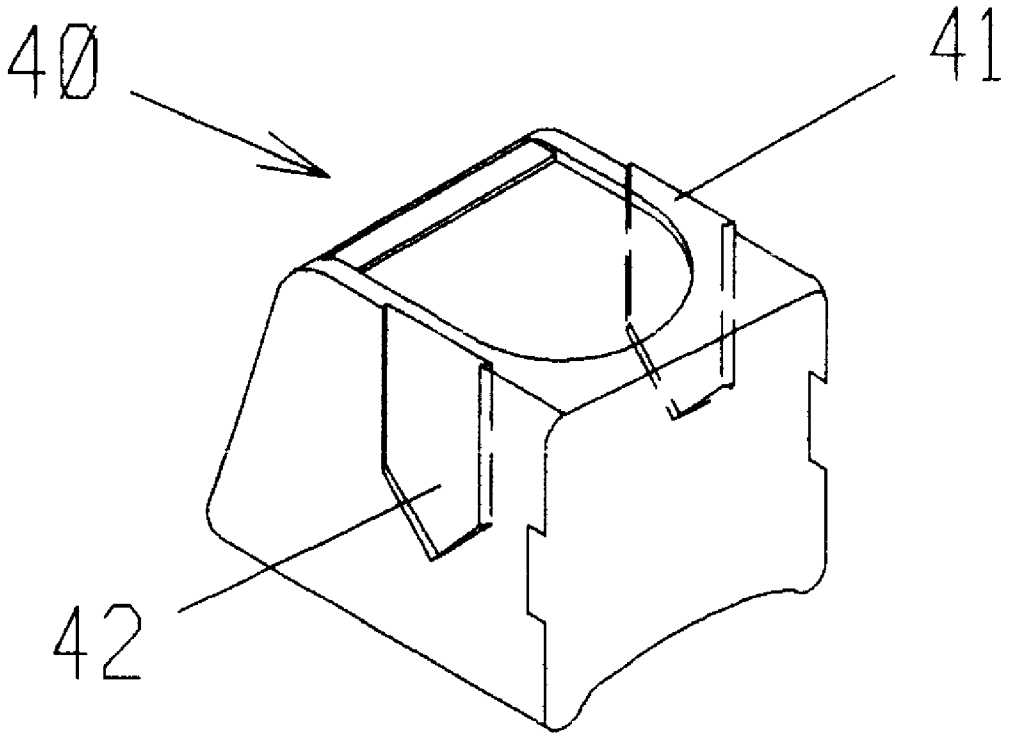
FIG. 4. A top angled phantom view of the outer shell showing opposing side channel locking sets for attaching extra one part or two part containers on one or both sides.

FIG. 4. 40 outer shell assembly with side channel locks.

41 male channel lock

42 female channel lock

FIG. 5. 5A one part container showing closure (door) closed.

5B one part container showing closure (door) open.

50 one part box-like container assembly.

51 closure means shown as a door

52 turning member

53 guide bar or rod.

54 shelf with exit slit at front end

55 space at back end of shelf

56 thumb space

Figure 6:
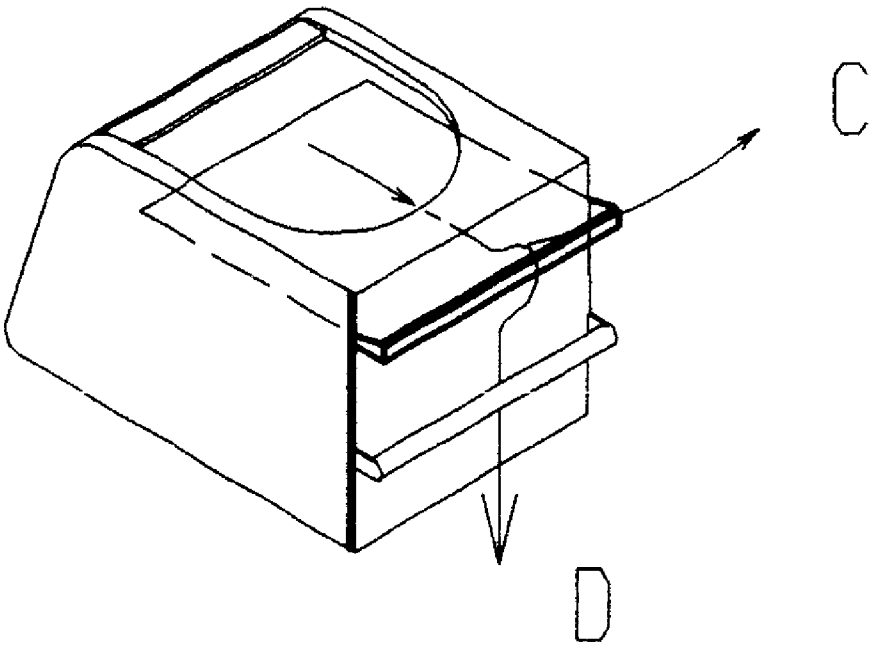
FIG. 6. The one part container of FIG. 5A showing the pathway for dispensing self-adhesive labels.

FIG. 6. C pathway for dispensed label

D pathway for substrate base paper

Figure 7:
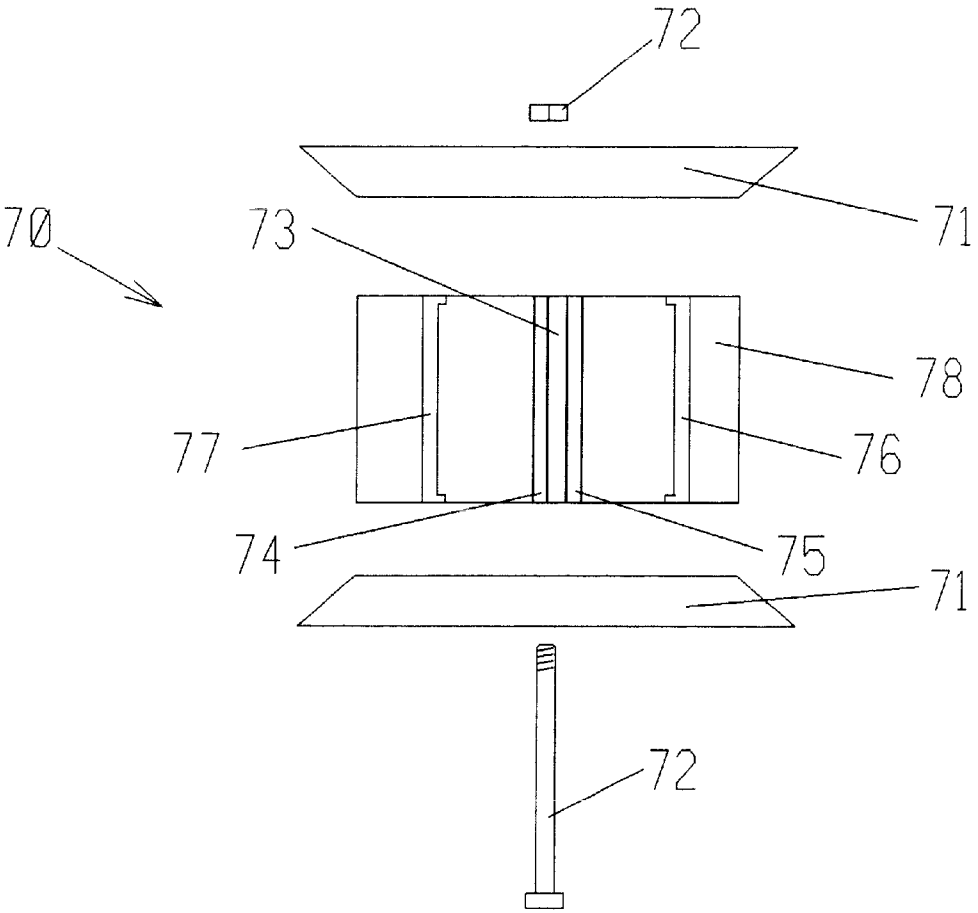
FIG. 7. An exploded side view of an invertable circular container with releasing mechanism on both sides of the exit slit.

FIG. 7. 70 exploded view of circular container for self-adhesive label dispensing.

71 interchangeable support parts, top and bottom

72 screw-nut set

73 exit slit in central cylinder

74 left turning member

75 right turning member

76 right guide bar or rod

77 left guide bar or rod

78 central cylinder with exit slit and two releasing mechanisms

Figure 8:
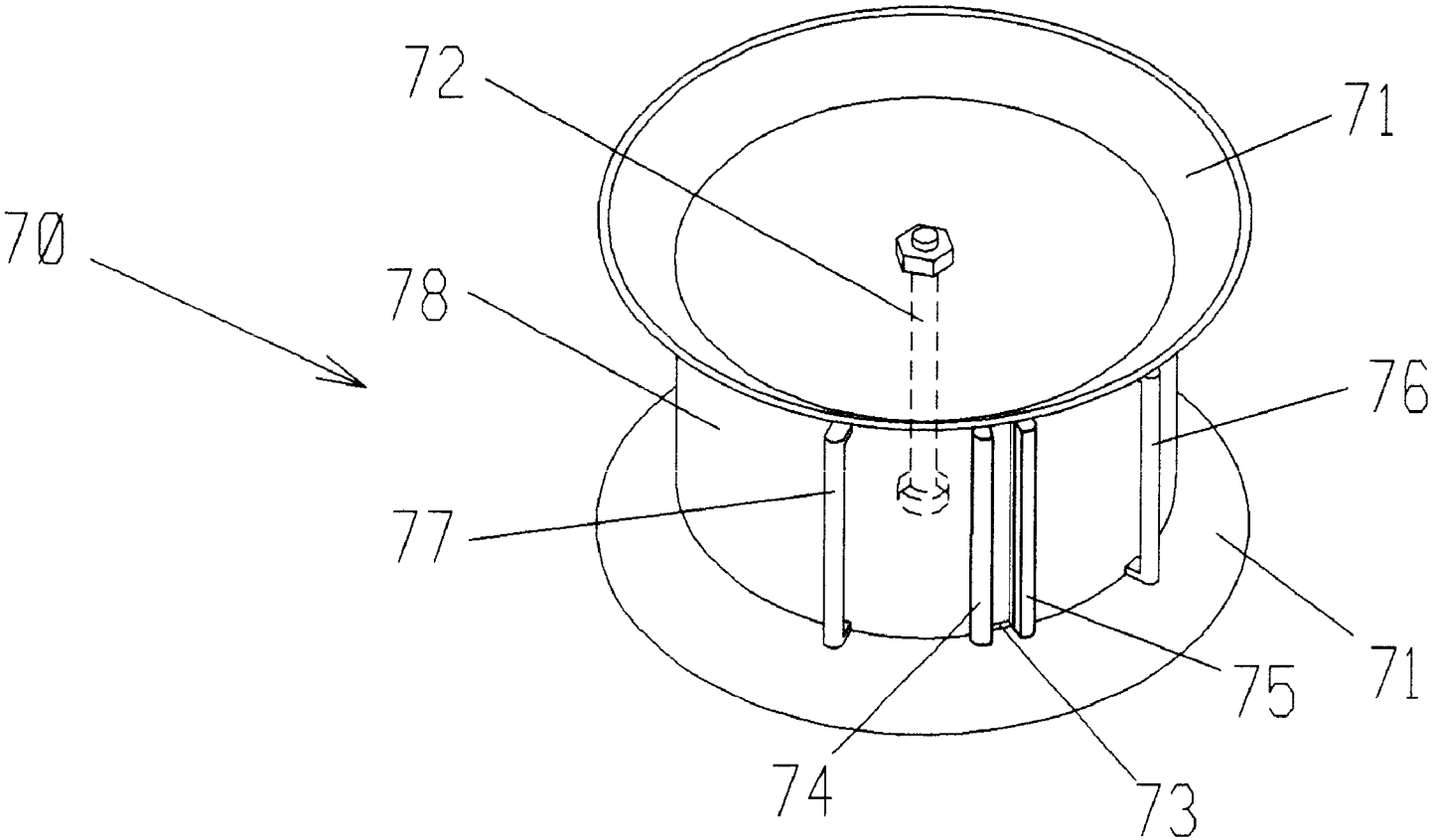
FIG. 8. An top angled view of the circular container of FIG. 7.

FIG. 8. Assembly showing circular container for dispensing self-adhesive labels to the left or to the right.

Figure 9:
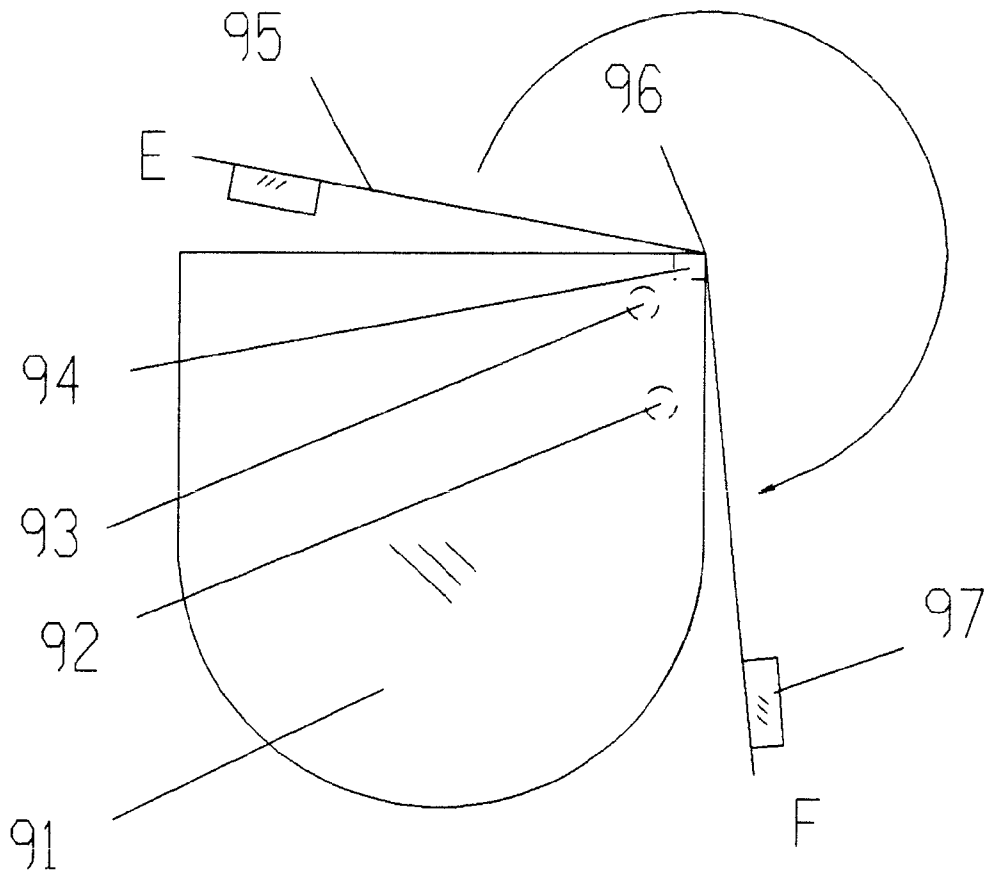
FIG. 9. A side view of a one part container showing the top closure partially opened and fully opened.

FIG. 9. 91 box-like container with top closure panel having one guide bar or rod; turning member, two guide bars or rods internal and adjacent to the turning member.

92 first guide bar or rod

93 second guide bar or rod

94 turning member

95 top closure panel in slightly opened position

96 hinge for top closure means

97 third guide bar or rod

E end of top closure panel when slightly open

F end of top closure panel when fully opened

Figure 10:
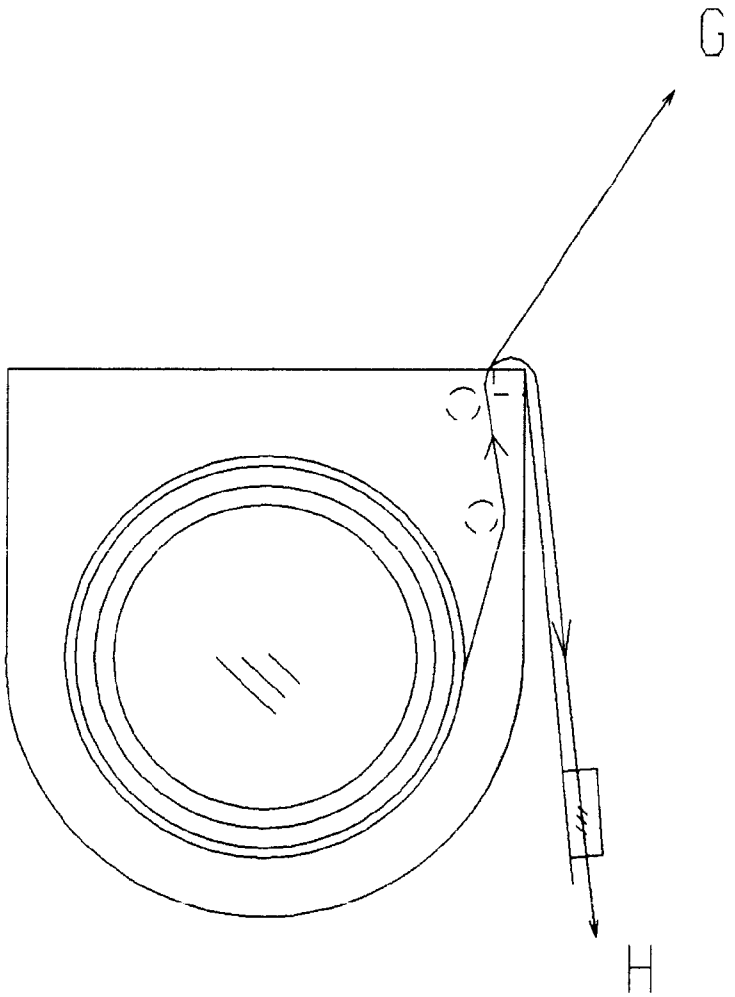
FIG. 10. A side view of the container of FIG. 9 showing the pathway for dispensing self-adhesive labels.

FIG. 10. G direction of label path

H direction of substrate base paper path

DETAILED DESCRIPTION OF THE PREFERRED EMBODIMENT

FIG. 1 shows the container assembly 10 composed of three parts, an outer shell 11 with one side open; a closure being an insert part 12 and a releasing mechanism 14 which is comprised of turning member 13 and one guide bar 15. The container is made in a variety of sizes and shapes and may have more than one guide bar or rod. The releasing mechanism 14 is comprised of turning member 13 which has an angled surface in the range of 80 to 135 degrees from the flat exit surface on the top of the closure insert 12 and guide bar 15 which is placed central to the top and bottom of the outside wall of the closure insert 12. In operation, the two parts, the outer shell 11 and the insert closure 12 are mated, the roll of self-adhesive labels having been placed inside the insert 12 with the end fed onto the top flat surface and extending out through an exit slit and over the turning member 13, several labels are removed by hand to expose the substrate base paper which is passed between the wall of the insert 12 and the guide bar 15. Gentle pulling on the substrate base paper will cause the roll to turn passing another label over the releasing mechanism.

FIG. 2 shows the pathway for dispensing labels where the roll of labels are inside the outer shell with the end of the labels passing over the top flat surface of the closure insert, turning downward as it moves over the turning member at which point the label separates from the substrate base paper, the substrate paper is passed under the guide bar. Pulling on the substrate paper in the A direction will release another individual label in the B direction.

FIG. 3 shows the closure insert 30 wherein the releasing mechanism assembly 14 of FIG. 1 is a separate part from the closure insert 30.

FIG. 4 shows the outer shell 40 having side wall opposing connector parts comprising a female channel slot 42 and an opposing male channel bar 41 either of which will attach to the channeling of another outer shell to connect them together. Another method of connecting containers together is to use magnets attached to the side walls or back wall .

FIG. 5 shows a container comprising a box 50 with a hinged door closure 51 having a turning member 52 at its top, a guide bar 53 at its center, the box 50 having an open space 56 on its top-surface where a thumb can put slight pressure on the labels, an inside shelf 54 being close to the inside top of the box 50 leaving an open space 55 between the shelf and the top of the box 50 which is 2 to 6 times the thickness of the label and substrate, the shelf 54 abutts the hinged door closure 51 when it is closed and so positioned that the labels exit through a slit onto the turning member 52. The shelf 54 is shortened leaving a space on the back end for the labels to pass from the roll to the end of the shortened shelf 54 and the box 50 back wall onto the top of shelf 54 to the exit slit and onto the turning member 52 where the label separates from the substrate base paper. The substrate base paper is passed under the guide bar 53.

FIG. 6 shows the pathway for the dispensing of labels in the box assembly 50 of FIG. 5 wherein the roll of labels is inside the container with the end passing through a back space onto the shelf 54 which directs the labels to the releasing mechanism on the hinged door closure 51. The label is separated from the substrate base paper at the turning member 52 and the substrate base paper turns down, passes between the wall of the box 50 and guide bar 53, the paper below the box 50 is discarded. Pulling on the substrate base paper at D will release an individual label in the direction of C.

FIG. 7 shows an exploded side view of a circular container assembly 70 having four parts. Legend numbers are defined in FIG. 8.

FIG. 8 shows a top angled view of the circular container of FIG. 7 wherein there is a releasing mechanism 74 and 75 on both sides of the exit slit 73. With this configuration the circular container 70 will dispense correctly for right-handed or left-handed persons. In circular container 70, the top and bottom 71 are the Same. Top and bottom are placed onto the central cylinder 78 and held together by means of screw-nut set 72. The container 70 can be used for dispensing to the left or right depending on the handedness of the user. In use, the roll of labels is put into the central cylinder 78 open interior area, an end of the label stock is fed through the opening 73 where it bends around the turning member 74 or 75, the label separates from the substrate base paper which passes under the guide bar 76 or 77 to be discarded. By pulling on the substrate base paper, a single label will be dispensed.

FIG. 9 is a side view of a bottom rounded box-like container 91 with a top opening closure means 95 having a guide bar 97 on it's interior end. A guide rod 92 is located interior and adjacent to the turning member 94 which has a second guide rod 93 positioned between the guide rod 92 and the turning member 94 and one and one-half diameters of the guide rod 92 in distance from the side wall of container 91. Top closure means 95 is rotated by means of hinge 96 from position E to position F when labels are to be dispensed. When top closure means 95 is rotated from position F to position E it can be pushed into the opening of container 91 to close it. The roll of self-adhesive labels is placed in the container 91, the end of the labels is passed between the 1st guide rod 92 and the side wall, between the $2^{nd}$ guide rod 93 and the side wall of container 91 around the turning member 94 where the label separates from the substrate base paper which is passed through the guide bar 97 on the top closure means 95 which is in the F position.

Having described several containers for dispensing labels from self-adhesive substrate base paper by means of my releasing mechanism attached integrally during manufacture or as a separate part after manufacture, it is my intention that the scope of this invention shall not be limited to the specific embodiments shown in the drawings but to include such other embodiments using the same invention.

I claim:

1. A dispenser for dispensing self-adhesive labels having a substrate, said dispenser comprising:

a label passage comprising top and bottom walls substantially adjacent top and bottom surfaces of said labels, and a label releasing mechanism located at a downstream end of said label passage, wherein said label releasing mechanism comprises:

one or more turning members, each of said turning members having a first substantially flat surface angled at 135 degrees relative to said label passage directing an exiting label along said substantially flat surface at a non-zero angle relative to said passage, and a second substantially flat surface having an angle of less than 90 degrees relative to said first surface, wherein said substrate travels adjacent said second surface after its separation from said labels, and one or more fixed guide bars or rods adjacent said one or more turning members for guiding said substrate along said second surface after separation from said exiting label.

2. The dispenser of claim 1, further comprising a two part container having one side open and an insert closure means having said releasing mechanism attached thereto.

3. The dispenser of claim 1, further comprising a one part container having a top opening, said opening having a hinged panel closure means, said closure means having said releasing mechanism attached thereto.

4. The dispenser of claim 1, further comprising a one part container having one side open, said open side having a hinged panel closure means, said closure means having said releasing mechanism attached thereto.

5. The dispenser of claim 1, further comprising a container having one side open, a closure means, and opposing side channels locks, one of said channel locks being male and one of said channel locks being female.

6. The dispenser of claim 1, further comprising a container having one side open, a closure means, and a magnet, wherein said magnet is attached to a back wall of said container.

* * * * *